United States Patent [19]

Fenner

[11] Patent Number: 4,706,525

[45] Date of Patent: Nov. 17, 1987

[54] VEHICLE DOOR UNLOCKING DEVICE

[75] Inventor: Brian A. Fenner, Groton, N.Y.

[73] Assignee: Cornell Research Foundation, Inc., New York, N.Y.

[21] Appl. No.: 816,761

[22] Filed: Jan. 7, 1986

[51] Int. Cl.[4] ..... B25B 33/00

[52] U.S. Cl. ..... 81/15.9; 81/64

[58] Field of Search ..... 81/15.9, 64, 3.43; 119/153; 43/86, 87; 294/19.1, 100; 70/465; 128/306, 307, 309, 320, 326, 327, 352, 353

[56] References Cited

U.S. PATENT DOCUMENTS

| | | | |
|---|---|---|---|
| 235,675 | 12/1880 | Ewing . | |
| 348,290 | 4/1969 | Konopacki . | |
| 511,148 | 12/1893 | Jones . | |
| 625,178 | 5/1899 | Lungren . | |
| 647,563 | 4/1900 | Gasser . | |
| 1,225,771 | 5/1917 | Clare | 128/320 |
| 1,798,221 | 3/1931 | Porwell | 294/100 |
| 2,027,009 | 3/1934 | Wyscaver . | |
| 2,344,696 | 3/1944 | Graham . | |
| 2,350,250 | 5/1944 | Pietrobon . | |
| 2,732,739 | 1/1956 | Liss . | |
| 2,885,917 | 5/1959 | Smith . | |
| 2,907,237 | 10/1959 | Casas . | |
| 3,340,750 | 9/1967 | Noorlun . | |
| 3,580,256 | 5/1971 | Wilkinson | 128/326 X |
| 3,664,211 | 5/1972 | McConnell . | |
| 3,819,221 | 6/1974 | O'Connor . | |
| 4,144,778 | 3/1979 | Waring . | |
| 4,326,530 | 4/1982 | Fleury, Jr. | 128/320 X |

FOREIGN PATENT DOCUMENTS

| | | | |
|---|---|---|---|
| 878735 | 10/1961 | United Kingdom | 119/153 |

*Primary Examiner*—Frederick R. Schmidt
*Assistant Examiner*—Debra S. Meislin
*Attorney, Agent, or Firm*—Jones, Tullar & Cooper

[57] ABSTRACT

A vehicle door unlocking device utilizes a pair of spaced, rigid hollow guide tubes to form a guide member that is insertable into the interior of a vehicle through an opening in the vehicle formed by the door or window and a resilient seal. A pair of flexible wires are slideably carried in the guide tubes and have manipulating handles on ends thereof which remain on the exterior of the vehicle. The ends of the wires positionable interiorly of the vehicle are manipulatable from outside the vehicle to form an enlarged loop that is positioned about a poor unlocking rod. Once the loop has been properly positioned, its size is reduced and the door lock rod can then be raised to unlock the vehicle door.

3 Claims, 4 Drawing Figures

FIG. 1
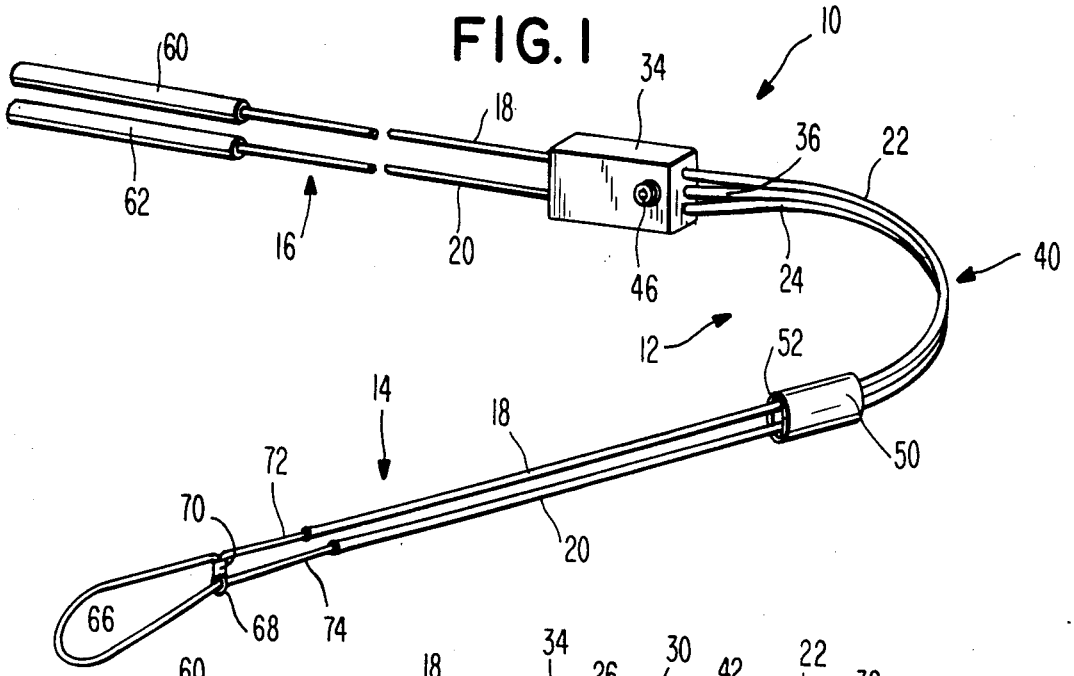
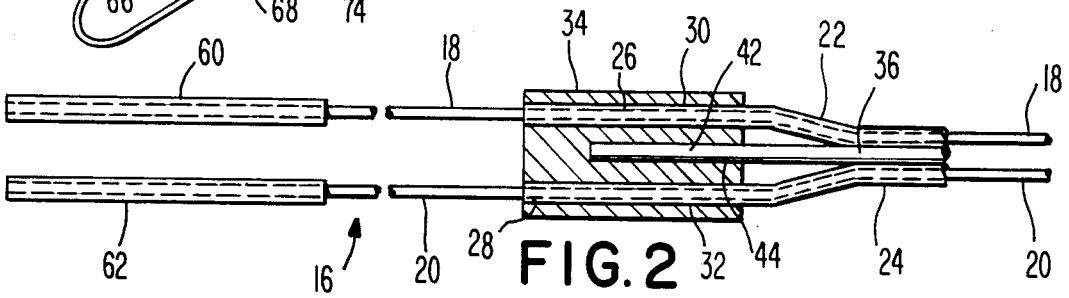
FIG. 2
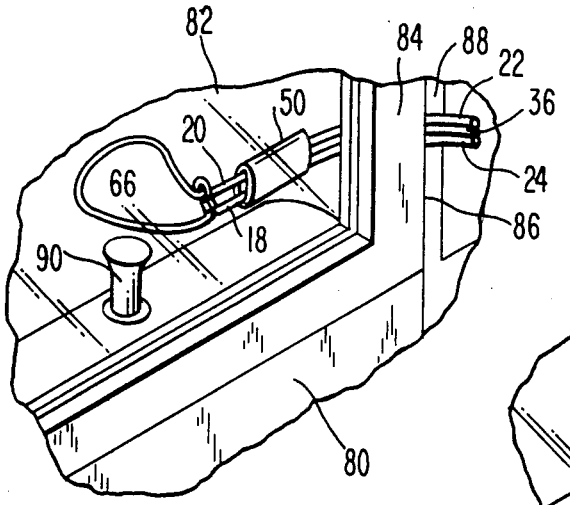
FIG. 3
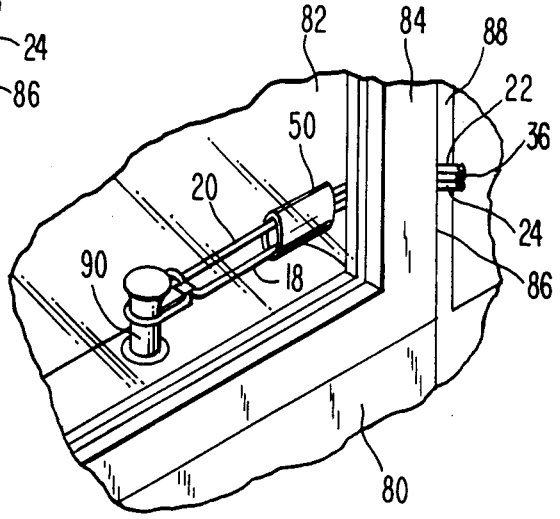
FIG. 4

VEHICLE DOOR UNLOCKING DEVICE

FIELD OF THE INVENTION

The present invention is directed generally to a vehicle door unlocking device. More particularly, the present invention is directed to a vehicle door unlocking device operable from the exterior of the vehicle to elevate the interior door lock rod. Most specifically, the present invention is directed to a vehicle door unlocking device having a door lock knob ensnaring loop formed of two flexible wires. The wires are supported and guided by a generally rigid guide member which is generally arcuate in shape and is insertable between a vehicle window or window frame and a cooperating resilient seal element or the like. The two flexible wires can then be remotely manipulated from the outside of the vehicle in such a manner that a loop that they form can be enlarged and placed over a door lock actuating knob or rod, and then tightened about the rod or knob. Once the flexible wire loop has been drawn tight about the door unlocking rod, the vehicle door unlocking device can be moved in an appropriate manner to unlock the vehicle's door.

DESCRIPTION OF THE PRIOR ART

In numerous situations the need arises to unlock a vehicle door when either the vehicle's owner, the vehicle's keys, or both are not present. Police officers, security officers, fire fighters and the like all are frequently faced with a situation where access to a vehicle must be obtained in a rapid manner. While such access can be accomplished either by breaking a window or in another similar destructive manner, this is not a satisfactory solution. Various other personnel, such as parking lot attendants, tow truck operators, locksmiths and various officials have a legitimate need to be able to obtain access to locked vehicles. Such access in situations of this nature should be obtained in a manner which is not harmful of the vehicle. Even though the vehicle's owner may have parked in an improper area, may have locked his vehicle when he should not have, or may have lost or misplaced his keys, he will expect that the person obtaining access to his car do so in a non-destructive manner.

Various prior art devices are generally known and are available for opening locked vehicle doors. Perhaps the most common of these devices is the so-called "slim jim" which is typically in the form of a long flat strip of spring steel having various hooks or slots formed at one end. This device is inserted down into the interior of the door and is then manipulated to unlock the door. Several drawbacks are inherent with this device. Initially, the user cannot actually see what he is doing with the end of the steel strip that has been inserted down inside the door. Thus the success of the attempted unlocking varies with the skill of the operator. Another problem with this type of tool is that it is somewhat large and cumbersome. It cannot be folded, collapsed or otherwise reduced in size when it is not being used and is somewhat cumbersome to transport or store. Additionally, many newer cars with internal door reinforcing beams cannot readily be unlocked using this device.

Most vehicle owners have probably been in the situation where they have inadvertently locked their keys inside their vehicle or have misplaced them. Attempts to unlock the vehicle are often made by using a wire coat hanger that has been reformed by being manually bent to have a loop in one end. This looped end is then inserted between the window and frame or between the door and frame and the coat hanger is manipulated to attempt to place the loop over the door locking knob or rod. Such crude devices are sometimes successful but often are not and quite frequently damage the vehicle. Various other prior art devices are basically refinements of the bent coat hanger but still suffer the same problems as well as also being cumbersome or bulky.

Vehicles are frequently equipped with electric door locks or with door lock actuating rods that do not have an enlarged free end. In the former case, the looped coat hanger type of unlocking device is not sufficiently strong to operate an electrically locked door while in the latter situation, the hook or loop, which is not adjustable in size once it has been inserted into the vehicle, merely slides up over the free end of the door lock actuating knob. In either situation, the presently available vehicle door unlocking devices have proven unsatisfactory.

It will be apparent that a need exists for a vehicle door unlocking device which overcomes the disadvantages of the prior art devices. The device should be small, able to be operated by the infrequent user, not damaging to the vehicle, and able to unlock various door configurations. The vehicle door unlocking device in accordance with the present invention, as will be discussed shortly, satisfies these requirements in a manner far superior to prior art devices.

SUMMARY OF THE INVENTION

It is an object of the present invention to provide a vehicle door unlocking device.

Another object of the present invention is to provide a vehicle door unlocking device utilizing flexible wires.

A further object of the present invention is to provide a vehicle door unlocking device utilizing a door lock rod encircling loop.

Yet another object of the present invention is to provide a vehicle door unlocking device in which the flexible wires are manipulatable exteriorly of the vehicle.

Still a further object of the present invention is to provide a vehicle door unlocking device having a rigid, arcuate guide sleeve which is positionable between the vehicle window and frame.

Even yet another object of the present invention is to provide a vehicle door unlocking device which is small, compact and inexpensive.

Yet still a further object of the present invention is to provide a vehicle door unlocking device that is simple to operate and which will not cause damage to the vehicle.

As will be discussed in greater detail in the description of the preferred embodiment, which is set forth subsequently, the vehicle door unlocking device in accordance with the present invention utilizes a pair of flexible elongated wires which pass through a rigid, generally arcuate guide sleeve. The wires are formed into an adjustably sized loop at a first, interior end, and are provided with manipulating handles at a second, exterior end. The guide sleeve has a loop protecting insertion tip which is shaped to facilitate insertion of the sleeve from the exterior of a vehicle into the interior of the vehicle as by insertion of the sleeve between the vehicle window glass and resilient seal or between the door frame and seal. Once the inner end of the guide sleeve has been placed within the vehicle, the flexible wires can be manipulated from outside of the vehicle to manipulate the wires and loop interiorly within the vehicle and into position about the door's unlocking rod. The loop may then be tightened by pulling one of the exterior wires. This secures the loop about the rod or knob so that it can be pulled upwardly by further tension being applied to the wire, by elevation of the wire guide sleeve, or by both to raise the knob and thereby unlock the door.

In contrast to prior art devices, the vehicle door unlocking apparatus of the present invention is small and easy to store. It can be carried in a shirt pocket, so that it is out of the way when not in use. Instead of requiring the operator to work in the dark as is the case of the "slim jim", the door unlocking device of the present invention is observable by the operator during usage. It is thus easier to use and does not require a great deal of skill.

The guide sleeve and insertion tip are rigid and shaped to be positionable between a window and resilient seal or between a door window frame and resilient seal in an expeditious manner. The guide sleeve will not damage the vehicle, either by tearing or ripping the resilient seal or by scratching the paint. During insertion of the guide sleeve, the insertion tip protects the flexible wire loop and prevents it from being bent or displaced. Once the guide sleeve is in place, the flexible wires are easily extended out away from the insertion tip by manipulation of the free, exterior ends of the wires. The loop can be enlarged, placed over the door lock actuating rod, and then tightened about the rod, all in an easy manner and all in clear view of the operator.

The vehicle door unlocking device in accordance with the present invention is much easier to use, carry, and store than prior art devices. It is simple to operate, durable, yet inexpensive to make and works well with various types of door locks, either manual or power. It does not damage the vehicle during use and can be used and positioned in whatever orientation the situation requires. It is superior to the previously known devices and performs its intended function in an expeditious manner.

BRIEF DESCRIPTION OF THE DRAWINGS

While the novel features of the vehicle door unlocking device in accordance with the present invention are set forth with particularity in the appended claims, a full and complete understanding of the invention may be had by referring to the detailed description of the preferred embodiment, as is set forth hereinafter, and as is illustrated in the accompanying drawings in which:

FIG. 1 is a perspective view of the vehicle door unlocking device in accordance with the present invention with the lengths of the flexible wires being shortened for purposes of illustration;

FIG. 2 is a partial view, partly in section, of a portion of the vehicle door unlocking device;

FIG. 3 is a perspective view of a portion of the vehicle door unlocking device depicting placement of the device and formation of the flexible wire loop; and FIG. 4 is a perspective view generally similar to FIG. 3 and showing the loop positioned about the vehicle door lock actuating knob.

DESCRIPTION OF THE PREFERRED EMBODIMENT

Referring initially to FIG. 1, there may be seen a preferred embodiment of a vehicle door unlocking device, generally at 10, in accordance with the present invention. Vehicle door unlocking device 10 is comprised generally of a rigid, arcuate guide sleeve, generally at 12, a loop forming interior flexible wire portion 14, and an exterior flexible wire manipulation portion 16. As will be discussed in greater detail shortly, the interior loop forming wire portion 14 and the exterior manipulation wire portion 16 both include two individual wires 18 and 20 which extend through the arcuate guide sleeve assembly 12. However, for ease of discussion and comprehension they will be discussed as interior wire portions 14 and exterior wire portions 16. The terms "interior" and "exterior" denote the location of the wire portions as being interior or exterior of the vehicle during usuage of the vehicle door unlocking device of the present invention.

Again referring to FIG. 1 and also to FIG. 2, rigid arcuate guide sleeve assembly 12 is comprised of a pair of hollow, spaced, rigid guide tubes 22 and 24. Each of these guide tubes is formed generally in a semi-circle and each is positioned at a first end 26, 28, respectively, in spaced bores 30, 32, respectively, formed in a mounting block 34. A rigid support or guide rod 36 is positioned between the guide tubes 22 and 24 and has a corresponding arcuate shape. The two guide tubes 22 and 24 and the guide rod 36 are joined together by suitable means such as soldering or the like to form a strong, rigid guide member 40. Rigid guide rod 36 has a first end 42 that is received in a central bore 44 in mounting block 34 where it is held by a set screw 46. If necessary, the hollow guide tubes 22 and 24 and solid guide rod 36 can be separated from mounting block 34 by loosening set screw 46 and sliding the hollow guide tubes 22 and 24 out of bores 30 and 32 and rigid guide rod 36 out of bore 44. A generally oval insertion tip 50 is attached to second ends of hollow guide tubes 22 and 24 and intermediate rigid guide rod 36. Insertion tip 50 is open at its free end 52 and forms a housing for the loop forming interior wire portion 14 during insertion of the guide member 40 into the interior of the vehicle whose door is to be unlocked.

It is important that the arcuate guide sleeve 12 be sufficiently strong to withstand the forces exerted on it during insertion between a vehicle window and resilient seal or door frame. At the same time, the guide sleeve 12 must be small and thin enough that it does not damage the vehicle during insertion. In the vehicle door unlocking device in accordance with the present invention, this is accomplished by making the two guide tubes 22 and 24 from stainless steel tubing having an outer diameter of generally about 1/16 inch with a wall thickness of 0.010 inches. Each of the guide tubes is about 6 inches long. The solid guide rod 36 has the same overall dimensions but is solid. A guide tube size substantially greater than 1/16 inch would make the assembly difficult to insert in many vehicles.

Turning now to FIG. 2, it may be seen that each of the flexible wires 18 and 20 passes through one of the hollow rigid guide tubes 22 and 24. These flexible wires are sized to pass freely through the hollow guide tubes 22 and 24. Furthermore, the wires 18 and 20 are sheathed in a friction reducing flexible plastic such as nylon or the like to render them less apt to snag or catch within the hollow guide tubes 22 and 24. The free end of each one of the exterior portions of flexible wires 18 and 20 is provided with a manipulating handle 60, 62. These manipulating handles 60, 62 are, in the preferred embodiment, larger diameter rigid plastic sleeves which are bonded to flexible wires 18 and 20. It should be noted that the actual lengths of wires 18 and 20 are greater than that shown in FIGS. 1 and 2 with the actual lengths of the wires 18 and 20 being sufficient to span the length of a typical vehicle door.

Referring again now to FIG. 1, a loop 66 is formed at the free end of the interior loop forming wire portion 14. This is accomplished by forming a small eye 68 in the first flexible wire 18 such as by passing the end of wire 18 down through a metal sleeve or ferrule 70 and back up into the ferrule thereby forming eye 68. The free end of the second flexible wire 20 is passed through eye 68 and is inserted down into the top of ferrule 70 adjacent wire 18. The ferrule 70 is then pressed closed to form loop 66 whose size can be adjusted by relative movement of wire 20 with respect to flexible wire 18. As may be seen in FIG. 1, the encircling plastic or nylon has been removed from the loop forming ends of flexible wires 18 and 20 leaving the underlying wires 72 and 74 exposed. This increases the flexibility of the loop 66 and makes it easier to open and close.

Referring now to FIGS. 3 and 4, there may be seen an operational sequence utilizing the vehicle door unlocking device 10 of the present invention to unlock a locked vehicle door 80. This door 80 is shown in a somewhat schematic manner and includes a conventional window 82 which, as shown in FIGS. 3 and 4, is slideable vertically in a rigid window frame 84. This is a structure typical of sedans and similar vehicles in which the window frame 84 moves with the door 80 during opening and closing, and in which an opening 86 between the window frame 84 and the vehicle roof support pillar 88 is sealed with a resilient sealing gasket (not shown). In an alternate configuration (not shown), the window 82 is frameless and seals directly against a sealing gasket carried by the vehicle roof support pillar 88 or by the rear window. In either situation, the vehicle door unlocking device 10 is positioned adjacent the exterior of the vehicle door and window with the flexible wires 18 and 20 retracted so that small loop 66 and eye 68 are shielded within the open end 52 of insertion tip 50. The insertion tip is then inserted between either the door frame 84 and resilient sealing gasket through opening 86 or between the window glass 82 and the resilient sealing gasket, depending on the style and configuration of the vehicle. Once the insertion tip 50 and guide member 40 have been inserted into the vehicle's interior, the small loop 66 and eye 68 can be extended out from the open free end 52 of insertion tip 50 by exerting a slight forward force on manipulating handles 60 and 62. The eye of loop 66 is then increased by continued forward movement of wire 20 through use of handle 62, while holding handle 60 stationary. As soon as the loop 66 has been sufficiently enlarged, it can be positioned about a door lock actuating rod or knob 90 positioned on the interior of vehicle door 80 in a generally known manner. The loop 66 is then made smaller by retraction of wire 20 until the loop is snug about knob 90. Continued retraction of flexible wires 18 and 20 will elevate knob 90 to unlock the door 80. In some situations, it is also beneficial to raise the guide member 40 to facilitate raising knob 90. Since loop 66 has been tightly secured about knob 90, there is little likelihood of the loop sliding up off knob 90 even if the knob does not have an enlarged head. The tight engagement of loop 66 about knob 90 is particularly beneficial when the vehicle is equipped with electric door locks since these require greater force to operate than do conventional, non-electric door locks. Once door 80 has been unlocked, it can be opened and the door unlocking device 10 can be removed by again enlarging loop 66 and removing it from knob 90. Loop 66 can then be reduced in size, placed within insertion tip 50 and the unlocking device 10 can be stored in a small amount of space.

As has been discussed above, the vehicle door unlocking device 10 of the present invention is small and easily stored yet is more effective than larger prior art devices. It is easy to operate and does not require a great deal of operator skill since it is always within the user's sight. It can be used with various styles and configurations of vehicles without harming or damaging window glass, window frames, door frames, paint and the like. It firmly grasps vehicle door lock actuating rods or knobs, even those without enlarged heads, and is able to also unlock many electric locks.

While a preferred embodiment of a vehicle door unlocking device in accordance with the present invention has been fully and completely set forth hereinabove, it will be obvious to one of skill in the art that a number of changes in, for example, the length of the flexible wires, the shape of the mounting block, the specific curvature of the guide tubes and guide rod, and the like could be made without departing from the true spirit and scope of the present invention which is accordingly to be limited only by the following claims.

What is claimed:

1. A vehicle door unlocking device for use with a vehicle having an openable door including a door unlocking means located within the interior of the vehicle, said vehicle door unlocking device comprising:

first and second spaced, rigid, arcuate hollow guide tubes, said guide tubes being joined to a solid guide rod positioned between said first and second spaced guide tubes, said first and second guide tubes and said guide rod forming a rigid, arcuate guide member sized and curved for insertion into the interior portion of the vehicle through an opening adjacent the openable door;

a mounting block having spaced bores, first ends of said guide tubes and said guide rod being secured in said spaced bores;

first and second flexible wires passing through said first and second hollow guide tubes respectively, and being freely slideable therewithin;

an eye formed at a first, interior portion of said first wire, a first, interior portion of said second wire passing through said eye and forming a door unlocking means ensnaring loop, said loop being capable of being varied in size by relative motion between said first and second wires to engage the door unlocking means;

a hollow insertion tip attached to second ends of said first and second guide tubes and said solid guide rod, said insertion tip forming a shield having an open end for storage of said eye and loop during insertion of said guide member into the interior portion of the vehicle; and enlarged manipulating handles formed on second, exterior portions of said first and second flexible wires, said size variation of said loop when said arcuate guide member is inserted through the opening adjacent the openable door and into the interior portion of the vehicle to cause said loop to securely engage the door unlocking means and to unlock the vehicle door being accomplished by manipulation of said manipulating handles and said guide member.

2. The vehicle door unlocking device of claim 1 wherein said first and second flexible wires carry a friction reducing covering.

3. The vehicle door unlocking device of claim 2 wherein said flexible wires at said loop are free of said friction reducing coating.

* * * * *